US007505052B2

(12) United States Patent
Choe et al.

(10) Patent No.: US 7,505,052 B2
(45) Date of Patent: Mar. 17, 2009

(54) METHOD AND APPARATUS FOR DISPLAYING IMAGE AND COMPUTER-READABLE RECORDING MEDIUM FOR STORING COMPUTER PROGRAM

(75) Inventors: Wonhee Choe, Gyeongsangbuk-do (KR); Changyeong Kim, Gyeonggi-do (KR); Seongdeok Lee, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 884 days.

(21) Appl. No.: 10/942,976

(22) Filed: Sep. 17, 2004

(65) Prior Publication Data

US 2005/0062767 A1 Mar. 24, 2005

(30) Foreign Application Priority Data

Sep. 19, 2003 (KR) ..... 10-2003-0065222

(51) Int. Cl.
*G09G 5/02* (2006.01)
*G09G 3/38* (2006.01)

(52) U.S. Cl. ..... 345/694; 345/695; 345/690

(58) Field of Classification Search ..... 345/694, 345/589, 88, 92, 96, 690, 698, 695, 696
See application file for complete search history.

(56) References Cited

U.S. PATENT DOCUMENTS 5,341,153 A * 8/1994 Benzschawel et al. ..... 345/694
6,002,423 A * 12/1999 Rappaport et al. ..... 348/42
6,188,385 B1 * 2/2001 Hill et al. ..... 345/614
6,317,158 B1 * 11/2001 Tice ..... 348/447
6,924,796 B1 * 8/2005 Someya et al. ..... 345/213
7,082,211 B2 * 7/2006 Simon et al. ..... 382/118
7,123,277 B2 * 10/2006 Brown Elliott et al. ..... 345/690
7,184,066 B2 * 2/2007 Elliot et al. ..... 345/694
7,221,381 B2 * 5/2007 Brown Elliott et al. ..... 345/690
7,268,748 B2 * 9/2007 Brown Elliott ..... 345/22
7,283,142 B2 * 10/2007 Credelle et al. ..... 345/694
7,292,253 B2 * 11/2007 Asai et al. ..... 345/613

(Continued)

FOREIGN PATENT DOCUMENTS

KR 2001-075103 8/2001

OTHER PUBLICATIONS

European Search Report issued by European Patent Office on Dec. 16, 2005.

(Continued)

*Primary Examiner*—Amare Mengistu
*Assistant Examiner*—Sarvesh J Nadkarni
(74) *Attorney, Agent, or Firm*—Staas & Halsey LLP

(57) ABSTRACT

A method and apparatus for displaying an image using a display pixel including at least one subpixel displaying one among four or more colors, and a computer-readable recording medium for storing a computer program for performing the method. A target phase of a target subpixel is adjusted using a difference between an absolute luminance value of a color to be displayed by the target subpixel and an absolute luminance value of a color to be displayed by at least one subpixel adjacent to the target subpixel. A relative luminance value of the target subpixel is obtained from a relative luminance value of at least one image pixel using a target filter having the adjusted target phase as a center of the target filter.

25 Claims, 9 Drawing Sheets

U.S. PATENT DOCUMENTS

2002/0015110 A1* 2/2002 Brown Elliott ..... 348/589
2002/0093521 A1 7/2002 Daly et al.
2002/0186229 A1* 12/2002 Brown Elliott ..... 345/649
2003/0085906 A1* 5/2003 Elliott et al. ..... 345/613
2003/0090581 A1* 5/2003 Credelle et al. ..... 348/273
2003/0103058 A1* 6/2003 Brown Elliott et al. ..... 345/589
2003/0128179 A1* 7/2003 Credelle ..... 345/88
2003/0128225 A1* 7/2003 Credelle et al. ..... 345/694
2004/0051724 A1* 3/2004 Elliott et al. ..... 345/694
2004/0080479 A1* 4/2004 Credelle ..... 345/88
2004/0234163 A1* 11/2004 Lee et al. ..... 382/298
2005/0062767 A1* 3/2005 Choe et al. ..... 345/694
2005/0174363 A1* 8/2005 Brown Elliott ..... 345/694
2007/0064020 A1* 3/2007 Credelle et al. ..... 345/694

OTHER PUBLICATIONS

Office Action issued Oct. 5, 2005 for Korean App. No. 10-2003-0065222.

* cited by examiner

METHOD AND APPARATUS FOR DISPLAYING IMAGE AND COMPUTER-READABLE RECORDING MEDIUM FOR STORING COMPUTER PROGRAM

CROSS-REFERENCE TO RELATED APPLICATIONS

This application claims the benefit of Korean Patent Application No. 2003-65222, filed on Sep. 19, 2003, in the Korean Intellectual Property Office, the disclosure of which is incorporated herein by reference.

BACKGROUND OF THE INVENTION

1. Field of the Invention

The present invention relates to a display device such as a liquid crystal display (LCD) or a plasma display panel (PDP), and more particularly, to an image display apparatus such as a monitor, a television, or a mobile display which includes a display device and displays a subpixel-based color image, an image display method therefor, and a computer-readable recording medium for storing a computer program.

2. Description of the Related Art

FIG. 1 is a diagram showing an example of a filter having an RGB stripe arrangement, used in a conventional image display apparatus. The filter includes a plurality of subpixels.

FIG. 2 is a diagram showing an example of a color filter used in a image display apparatus. The color filter includes a plurality of subpixels.

Referring to FIG. 1, each subpixel displays one color component among red (R), green (G) and (B) color components of an image signal. A single display pixel includes three subpixels displaying R, G and B color components, respectively. The subpixels shown in FIG. 1 are individually controlled to display an image, and therefore, a horizontal resolution triples theoretically when a black and white image is displayed. Each subpixel shown in FIG. 2 displays one color component among R, G, B and white (W) color components. Here, a display pixel includes a plurality of subpixels displaying R, G and B color components, R, W and G color components, G, W and R color components, or G, B and R color components.

Such a conventional image display apparatus, which displays an image by subpixel rendering, can decrease occurrence of a jagged pattern. The jagged pattern usually occurs at a boundary of a fine character such as an italic font when the resolution of an input content is higher than a resolution at which an image display apparatus can display an image.

However, a color image displayed on the conventional image display apparatus displaying an image by subpixel rendering may have a color fringe due to a phase shift of subpixels when a brightness value rapidly changes among the subpixels at a boundary of the color image. The color fringe may be different depending on an arrangement of subpixels. For example, in the stripe arrangement shown in FIG. 1, the color fringe may occur on a diagonal. In a delta arrangement, the color fringe may occur on a vertical straight line. In particular, the color fringe is more prominent when chrominance components are periodically arranged in units of two or more groups of subpixels, as shown in FIG. 2, than when chrominance components are periodically arranged in units of one display pixel as in the stripe arrangement shown in FIG. 1.

A conventional apparatus for displaying an image based on a subpixel is disclosed in U.S. Pat. No. 5,341,153, entitled "Method of and Apparatus for Displaying a Multicolor Image." In the conventional method and apparatus for displaying a high resolution multicolor image on a lower resolution display, a single image pixel is expressed with being divided into subpixels displaying R, G and B color components to increase the resolution of the display. However, such a conventional image display method and apparatus in which a subpixel of interest is expressed by an average of adjacent image pixels have disadvantages of increasing image blurring and causing a color fringe when brightness rapidly changes among chrominance components.

FIG. 3 is a graph illustrating characteristics of human sight according to a spatial frequency of an image. In the graph, the horizontal axis indicates cycles per degree (c/d), and the vertical axis indicates contrast sensitivity.

Unlike the conventional image display method and apparatus in which a subpixel is expressed by an average of adjacent image pixels, another conventional image display method and apparatus in which a chrominance component of a subpixel is expressed in consideration of characteristics of human sight is disclosed in U.S. Patent Publication No. 2002/0093521 A1, entitled "Methods and Systems for Improving Display Resolution in Images Using Subpixel Sampling and Visual Error Filtering." In the conventional image display method and apparatus disclosed in U.S. Patent Publication No. 2002/0093521 A1, a luminance value of a chrominance component to be expressed by a subpixel is calculated using an optimal filter that is designed in consideration of the characteristics of human sight, i.e., a theoretical visibility range of a user, thereby improving a display resolution. As shown in FIG. 3, the human sight is very sensitive to the luminance Contrast Sensitivity Function (CSF) of an image but is less sensitive to a chrominance component such as red-green CSF or blue-yellow CSF of the image. However, since the optimal filter is designed in consideration of the theoretical visibility range, the above-described image display method and apparatus are not suitable for a mobile environment, i.e., when a fluid visibility range needs to be secured to display an image. Moreover, since the conventional image display method and apparatus use the filter designed to operate in an opponent color space, unnecessary complex color space conversion is required.

In addition, in the conventional image display methods and apparatuses, each subpixel displays only one among three colors, as shown in FIG. 1, but a high-resolution color image cannot be displayed without a color fringe when each subpixel displays one among four colors, as shown in FIG. 2, or one among more than four colors.

SUMMARY OF THE INVENTION

The present invention provides a method of performing subpixel rendering to minimize a color fringe in an image display where each subpixel displays one among four or more colors.

The present invention also provides an image display apparatus for performing subpixel rendering to minimize a color fringe where each subpixel displays one among four or more colors.

The present invention also provides a computer-readable recording medium storing a computer program for performing subpixel rendering to minimize a color fringe where each subpixel displays one among four or more colors.

According to an aspect of the present invention, there is provided a method of displaying an image using a display pixel comprising at least one subpixel displaying one among four or more colors. The method comprises adjusting a target phase of a target subpixel using a difference between an absolute luminance value of a color to be displayed by the target subpixel and an absolute luminance value of a color to be displayed by at least one subpixel adjacent to the target subpixel, and obtaining a relative luminance value of the target subpixel from a relative luminance value of at least one image pixel using a target filter having the adjusted target phase as a center of the target filter. A brightness of the color displayed by the target subpixel may correspond to the relative luminance value of the target subpixel.

According to another aspect of the present invention, there is provided an apparatus for displaying an image using a display pixel comprising at least one subpixel displaying one among four or more colors. The apparatus comprises a phase adjustment unit which adjusts a target phase of a target subpixel using a difference between an absolute luminance value of a color to be displayed by the target subpixel and an absolute luminance value of a color to be displayed by at least one subpixel adjacent to the target subpixel, and a luminance value generation unit which generates a relative luminance value of the target subpixel from a relative luminance value of at least one image pixel using a target filter having the adjusted target phase as its center. A brightness of the color displayed by the target subpixel may correspond to the generated relative luminance value of the target subpixel.

According to still another aspect of the present invention, there is provided a computer-readable recording medium storing at least one computer program to control an apparatus for displaying an image using a display pixel comprising at least one subpixel displaying one among four or more colors. The computer program adjusts a target phase of a target subpixel using a difference between an absolute luminance value of a color to be displayed by the target subpixel and an absolute luminance value of a color to be displayed by at least one subpixel adjacent to the target subpixel, and obtains a relative luminance value of the target subpixel from a relative luminance value of at least one image pixel using a target filter having the adjusted target phase as its center. A brightness of the color displayed by the target subpixel may correspond to the relative luminance value of the target subpixel.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
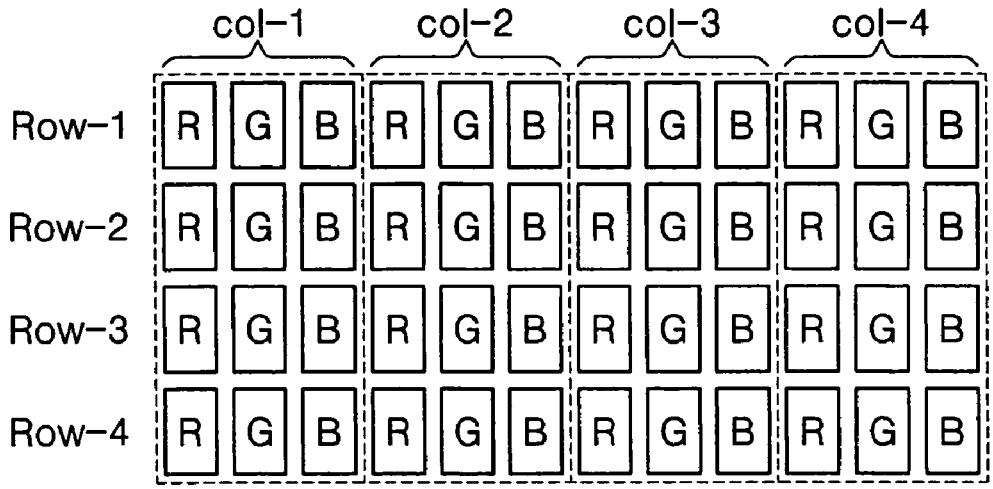
FIG. 1 (PRIOR ART)
FIG. 1 is a diagram showing an example of a filter having an RGB stripe arrangement, used in a conventional image display apparatus.
Figure 2:
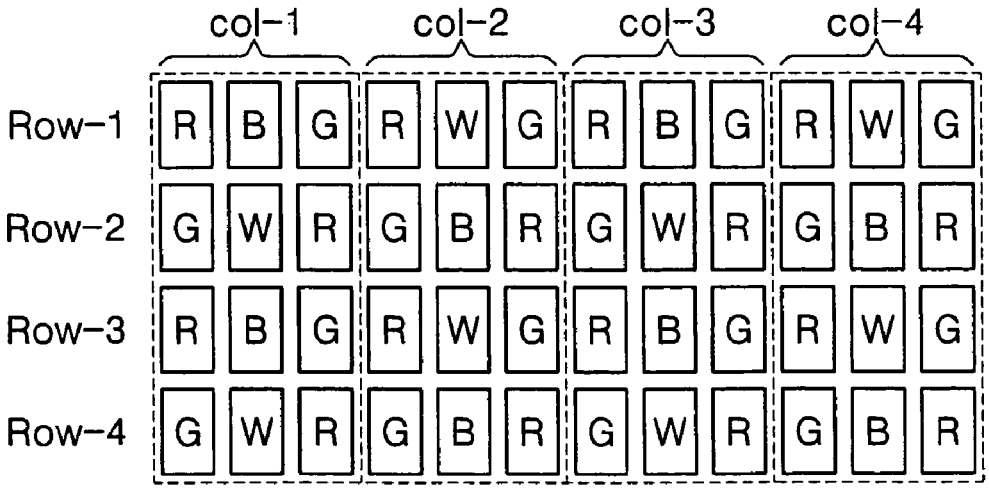
FIG. 2 (PRIOR ART)
FIG. 2 is a diagram showing an example of another color filter used in a conventional image display apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, a method of displaying an image according to the present invention will be described with reference to the accompanying drawings.

Figure 4:
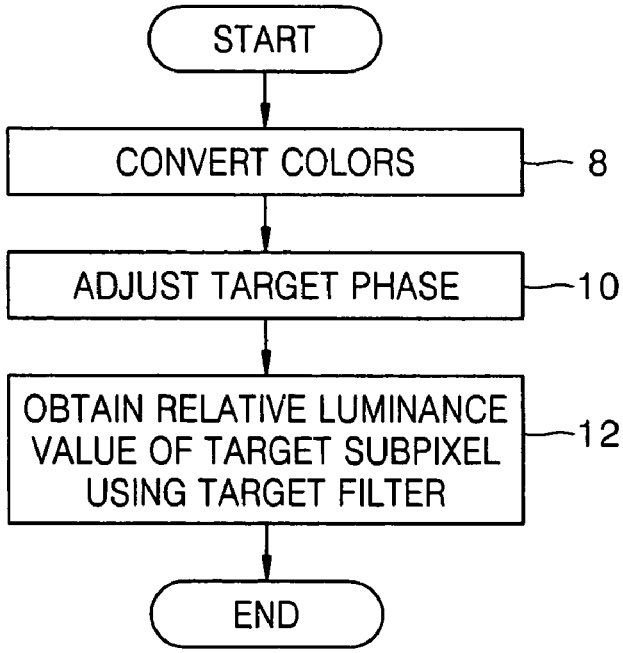
FIG. 4 is a flowchart of a method of displaying an image according to the present invention.

FIG. 4 is a flowchart of a method of displaying an image according to the present invention. The image display method comprises converting colors in operation 8, adjusting a target phase in operation 10, and obtaining a relative luminance value of a target subpixel in operation 12.

Figure 5:
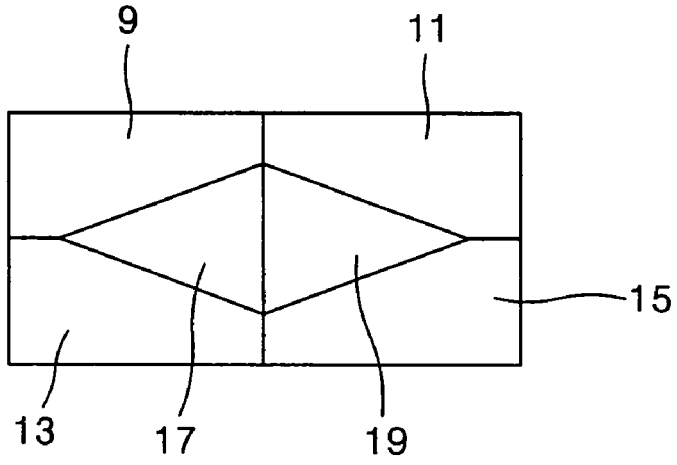
FIG. 5 is a diagram showing an example of an arrangement of subpixels.

FIG. 5 is a diagram showing an example of an arrangement of subpixels. The arrangement includes six subpixels 9, 11, 13, 15, 17 and 19.

In the method of displaying an image according to the present invention, an image is displayed by display pixels as follows. A single display pixel comprises at least one subpixel. For example, the subpixels 9, 111 and 17 may asymmetrically constitute a display pixel, and the subpixels 13, 15 and 19 may asymmetrically constitute another display pixel. Each of the subpixels 9, 11, 13, 15, 17 and 19 displays one among four or more colors that may include, for example, red (R), green (G), blue (B) and white (W). For example, the six subpixels 9, 11, 13, 15, 17 and 19 may display R, G, G, R, B and W, respectively.

According to the present invention, the four or more colors may necessarily include a color having a high absolute luminance value, e.g., W.

In the method of displaying an image according to an embodiment of the present invention, three externally input colors, for example, R, G and B, are converted into four or more colors, for example, R, G, B and W, in operation 8. In addition to color conversion, gamma compensation may be performed in operation 8. In another embodiment of the present invention, the image display method shown in FIG. 8 may not include operation 8.

A target phase of a target subpixel is adjusted using a difference between an absolute luminance value of a color to be displayed by the target subpixel and an absolute luminance value of a color to be displayed by at least one subpixel adjacent to the target subpixel in operation 10. A target subpixel is defined as a subpixel that is a current target in obtaining a relative luminance value according to the method of displaying an image according to the present invention. The absolute luminance value is defined as a luminance value that identifies a particular color included in a color gamut from white to black and differs from a relative luminance value defined as a degree of brightness of each color included in the color gamut. A phase indicates the center of a filter corresponding to a subpixel. Accordingly, the center of a target filter corresponding to a target subpixel is defined as a target phase (also referred to as a target phase of a target subpixel), and the center of an adjacent filter corresponding to a subpixel adjacent to the target subpixel is defined as an adjacent phase.

According to a first embodiment of the present invention, when an adjacent subpixel displays color having a high absolute luminance value, a target phase may be shifted such that a distance between the target phase and the center of gravity of the adjacent subpixel becomes farther. The center of gravity indicates the center of an area occupied by a subpixel in physical space. For example, when an adjacent subpixel displays white, a target phase must be shifted such that a distance between the target phase and the center of gravity of the adjacent subpixel displaying white becomes larger in order to reduce a color fringe. However, when the target phase is shifted too far from the center of gravity of the adjacent subpixel, a resolution of an image displayed by the target subpixel decreases. Accordingly, an appropriate trade-off may be set.

Figure 6:
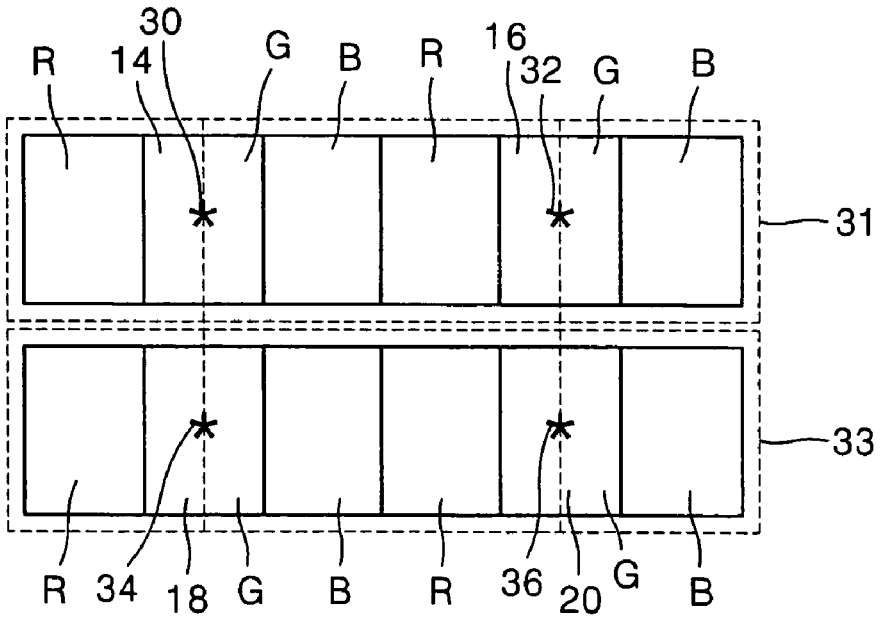
FIG. 6 is a diagram showing an example of an arrangement of subpixels, each subpixel displaying one among three chrominance components in physical space.

FIG. 6 is a diagram showing a first example of an arrangement of subpixels, each of which displays one among three chrominance components in physical space. Reference numerals 30, 32, 34 and 36 indicate the centers of gravity (*) of subpixels 14, 16, 18 and 20, respectively, displaying G.

Figure 7:
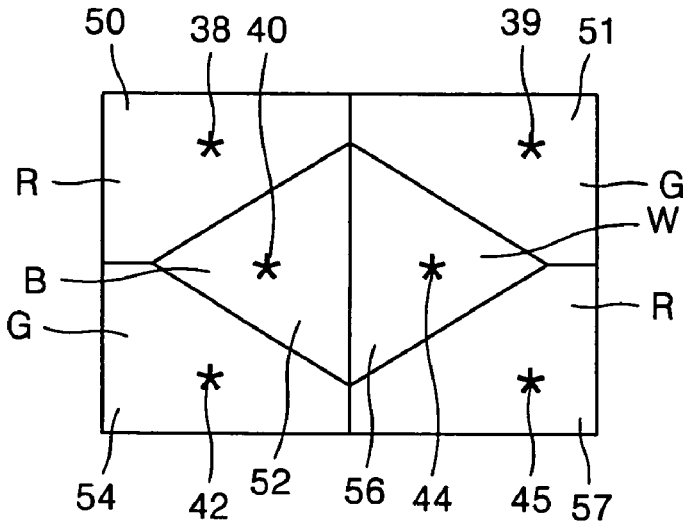
FIG. 7 is a diagram showing an example of an arrangement of subpixels, each subpixel displaying one among four chrominance components in physical space.

FIG. 7 is a diagram showing a second example of an arrangement of subpixels, each of which displays one among four chrominance components in physical space. Reference numerals 38, 39, 40, 42, 44 and 45 respectively denote the centers of gravity (*) of subpixels 50, 51, 52, 54, 56 and 57 which respectively display R, G, B, G, W and G.

Figure 8:
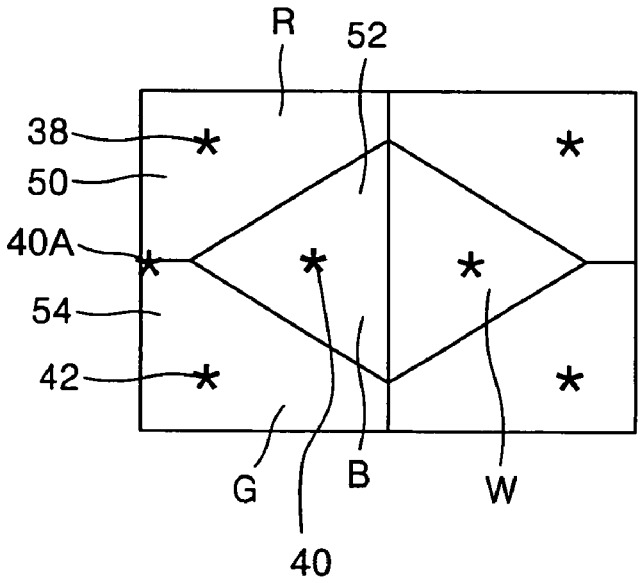
FIG. 8 is a diagram showing another example of an arrangement of subpixels, each subpixel displaying one among four chrominance components in physical space.

FIG. 8 is a diagram showing a third example of an arrangement of subpixels, each of which displays one among four chrominance components in physical space. The reference numerals 38, 40 and 42 respectively denote the centers of gravity (*) of the subpixels 50, 52 and 54 which respectively display R, B and G. In FIG. 7, the target phase of subpixel 52 coincides with the center of gravity 40 of subpixel 52. In FIG. 8, the target phase is shown moved to a position 40A relative to the center of gravity 40 of subpixel 52.

Each subpixel shown in FIG. 6 displays one among three colors, R, G and B. When each subpixel shown in FIG. 6 can display a fourth color, for example, W, in addition to the three colors, R, G and B, a physical space of each subpixel shown in FIG. 6 can be changed into that shown in FIG. 7. When a horizontal resolution of half of the subpixels shown in FIG. 6 is compared with a horizontal resolution of half the subpixels shown in FIG. 7, an upper subpixel group 31 shown in FIG. 6 has only two phases 30 and 32 while an upper subpixel group including the subpixels 50, 51 and 52 shown in FIG. 7 has three phases 38, 39 and 40. Similarly, a lower subpixel group 33 shown in FIG. 6 has only two phases 34 and 36 while a lower subpixel group composed of the subpixels 54, 56 and 57 shown in FIG. 7 has three phases 42, 44 and 45. Accordingly, when the subpixels shown in FIG. 7 are used, a resolution of an image can be increased by 1.5 times as compared to when the subpixel shown in FIG. 6 are used.

When the target subpixel 52 displays B and the adjacent subpixel 56 displays a color, for example, W, having a high absolute luminance value, the target phase 40 can be shifted such that a distance between the target phase 40 and the center-of-gravity 44 of the adjacent subpixel 56 becomes larger. For example, the target phase 40 shown in FIG. 7 can be shifted to the left, as shown in FIG. 8.

According to a second embodiment of the present invention, a target filter may be made to overlap at least one adjacent filter by shifting a target phase and an adjacent phase of at lease one adjacent subpixel.

According to a third embodiment of the present invention, a target filter can be made to overlap one or more adjacent filters in a single common area by shifting a target phase and an adjacent phase of at lease one adjacent subpixel.

When a target filter overlaps at least one adjacent filter, as described in the second and third embodiments, a color fringe caused by a radical change in brightness of color between subpixels is minimized.

The second and third embodiments of the present invention will be described in detail with reference to FIGS. 6 and 7.

According to the second and third embodiments, all of the target phase 40 and the adjacent phases 38 and 42 may be shifted, for example, to the left, as shown in FIG. 8. In this situation, a target filter having the shifted target phase 40 shown in FIG. 8 as a center of the target filter may overlap adjacent filters respectively having the shifted adjacent phases 38 and 42 shown in FIG. 8 as their centers. Since the phase 40 of the subpixel 52 displaying B and the phases 38 and 42 of the respective subpixels 50 and 54 respectively displaying R and G are shifted, the influence of W upon B is reduced.

Figure 9:
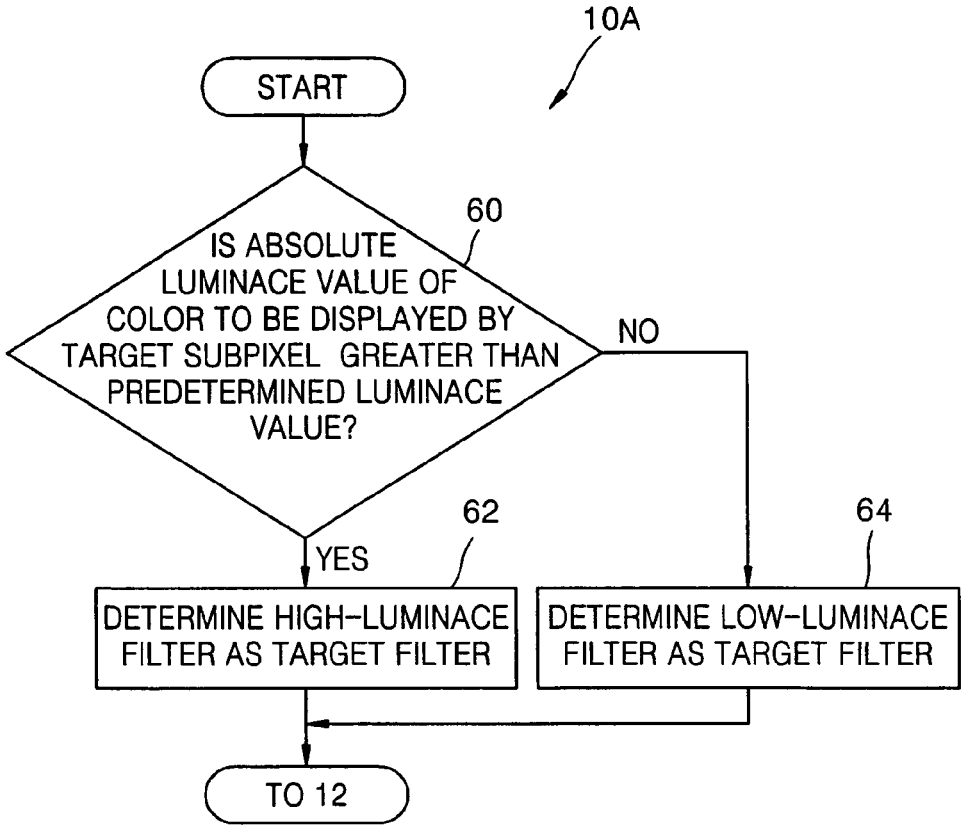
FIG. 9 is a flowchart of an embodiment an operation shown in FIG. 4.

FIG. 9 is a flowchart of an embodiment of operation 10 shown in FIG. 4 according to the present invention. Operation 10 comprises determining a type of target filter according to a result of comparing an absolute luminance value of a color to be displayed by a target subpixel with a predetermined luminance value in operations 60 through 64.

According to the present invention, a determination whether the absolute luminance value of the color to be displayed by the target subpixel is greater than the predetermined luminance value is made in operation 60. According to the present invention, the predetermined luminance value may be set to be close to an absolute luminance value of green.

Where a determination is made that the absolute luminance value of the color to be displayed by the target subpixel is greater than the predetermined luminance value, a high-luminance filter is determined as the target filter in operation 62, and the process goes to operation 12. The color displayed by the target subpixel having the higher absolute luminance value than the predetermined luminance value is Y in YCbCr, luminance (L) in Lab, white, cyan, or yellow in an opponent color space. A high-luminance filter has a characteristic of filtering a high luminance component of the color.

Figure 10:
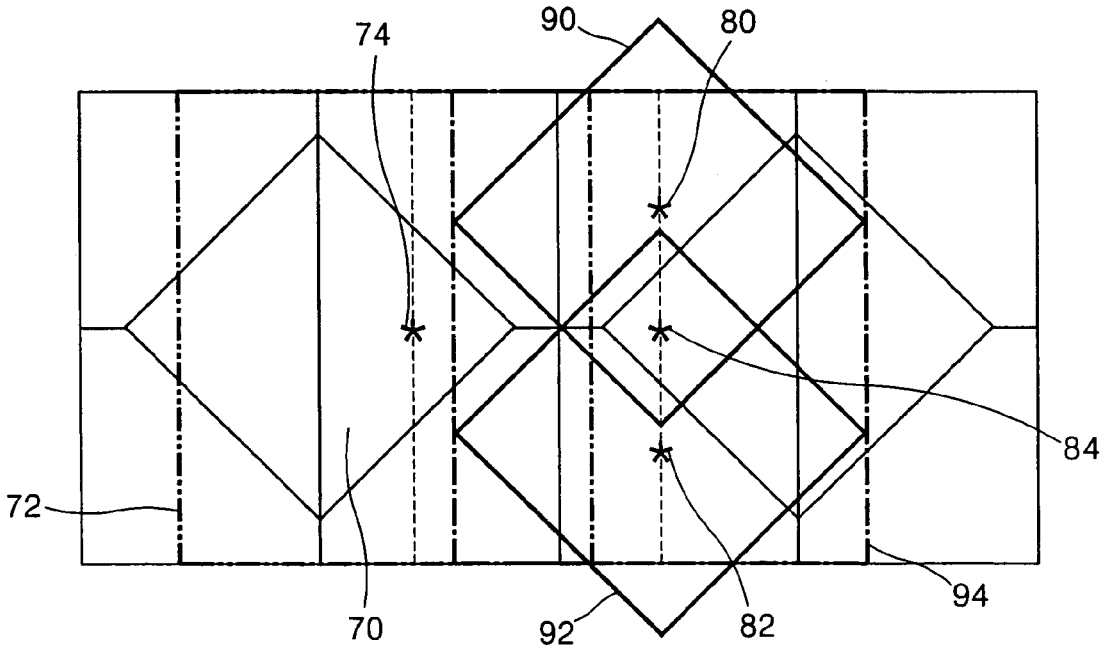
FIG. 10 is a diagram showing an example of a target filter to be applied to a target subpixel displaying a color having a relatively high absolute luminance value.

FIG. 10 is a diagram showing an example of a target filter to be applied to a target subpixel displaying a color having a relatively high absolute luminance value.

According to embodiments of the present invention, where a determination is made that an absolute luminance value of a color to be displayed by a target subpixel 70 is greater than the predetermined luminance value, a target phase may be positioned at a center of gravity 74 of the target subpixel 70 in physical space in operation 62. Accordingly, a target phase positioned at the center-of-gravity 74 becomes the center of the high-luminance filter determined as a target filter 72. As described above, the high-luminance filter to be applied to a subpixel displaying a color having a relatively high absolute luminance value is formed to be independent of adjacent filters.

According to embodiments of the present invention, where a determination is made that an absolute luminance value of a color to be displayed by the target subpixel 70 is greater than the predetermined luminance value, the target phase 74 may be shifted such that a distance between the target phase 74 and the adjacent phases 80, 82 and 84 becomes larger in operation 62. Low-luminance filters 90, 92 and 94 have the adjacent phases 80, 82 and 84, respectively, as their centers. The shifted position of the target phase becomes the center 74 of the high-luminance filter determined as the target filter 72. In other words, when adjacent filters are low-luminance filters, a target filter is shifted such that a distance between the target filter and the adjacent filters becomes larger.

Meanwhile, where a determination is made that the absolute luminance value of the color to be displayed by the target subpixel is equal to or less than the predetermined luminance value, a low-luminance filter is determined as the target filter in operation 64, and the process goes to operation 12. A low luminance filter has a characteristic of filtering a low luminance component of the color.

Figure 11:
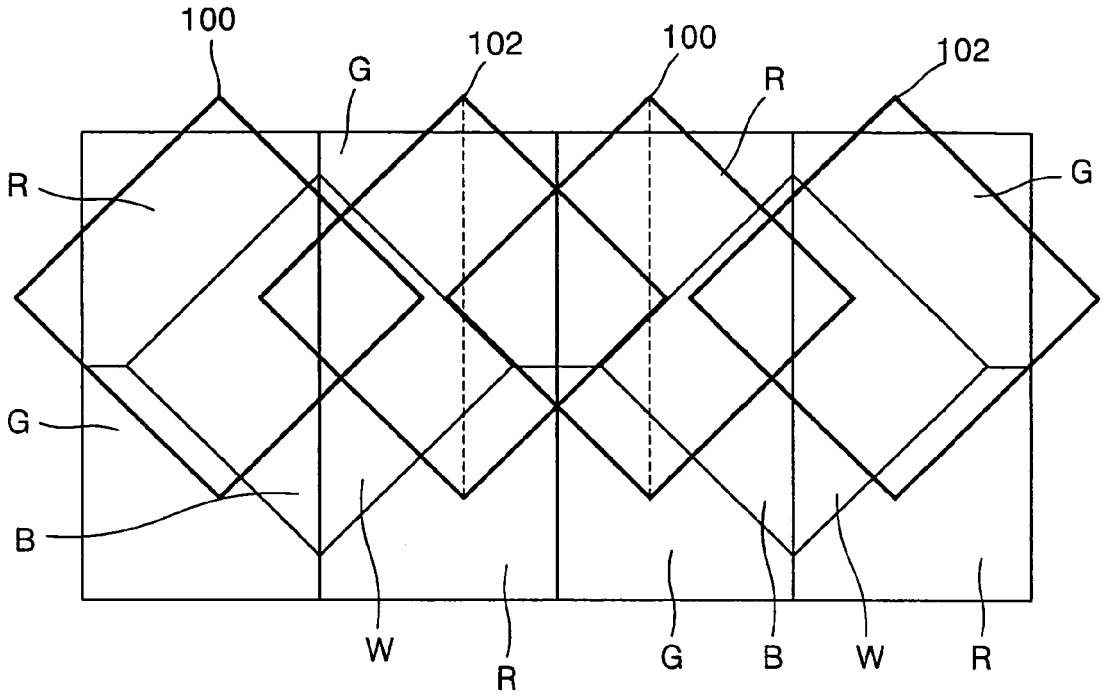
FIG. 11 is a diagram showing an example of a target filter to be applied to a target subpixel displaying a color having a relatively low absolute luminance value.

FIG. 11 is a diagram showing an example of a target filter to be applied to a target subpixel displaying a color having a relatively low absolute luminance value.

According to embodiments of the present invention, where a determination is made that an absolute luminance value of a color to be displayed by the target subpixel 50 shown in FIG. 7 is equal to or less than the predetermined luminance value, a target phase is positioned at the center-of-gravity 38 of the target subpixel 50, and an adjacent phase of the adjacent subpixel 54 is positioned at the center-of-gravity 42 of the adjacent subpixel 54. Then, the target phase and the adjacent phase positioned at the centers of gravity 38 and 42, respectively, are shifted, as shown in FIG. 8, so that, for example, a target filter 100 overlaps an adjacent filter 102, as shown in FIG. 11. In this situation, the target filter 100 corresponds to the low-luminance filter in operation 64 and is used to obtain a relative luminance value of the target subpixel 50 displaying R. A color having a low absolute luminance value has a high saturation.

Similarly, where a determination is made that an absolute luminance value of a color to be displayed by the target subpixel 54 shown in FIG. 7 is equal to or less than the predetermined luminance value, a target phase is positioned at the center of gravity 42 of the target subpixel 54, and an adjacent phase of the adjacent subpixel 50 is positioned at the center of gravity 38 of the adjacent subpixel 50. Then, the target phase and the adjacent phase positioned at the centers-of-gravity 42 and 38, respectively, are shifted, as shown in FIG. 8, so that, for example, a target filter 102 overlaps an adjacent filter 100, as shown in FIG. 11. In this situation, the target filter 102 corresponds to the low-luminance filter in operation 64 to be used to obtain a relative luminance value of the target subpixel 54 displaying G.

Consequently, referring to FIG. 11, RGBWGR is not regarded as a group, but RG or GR is regarded as a group so that one of two types of the low-luminance filters 100 and 102 is determined as a target filter.

Figure 12:
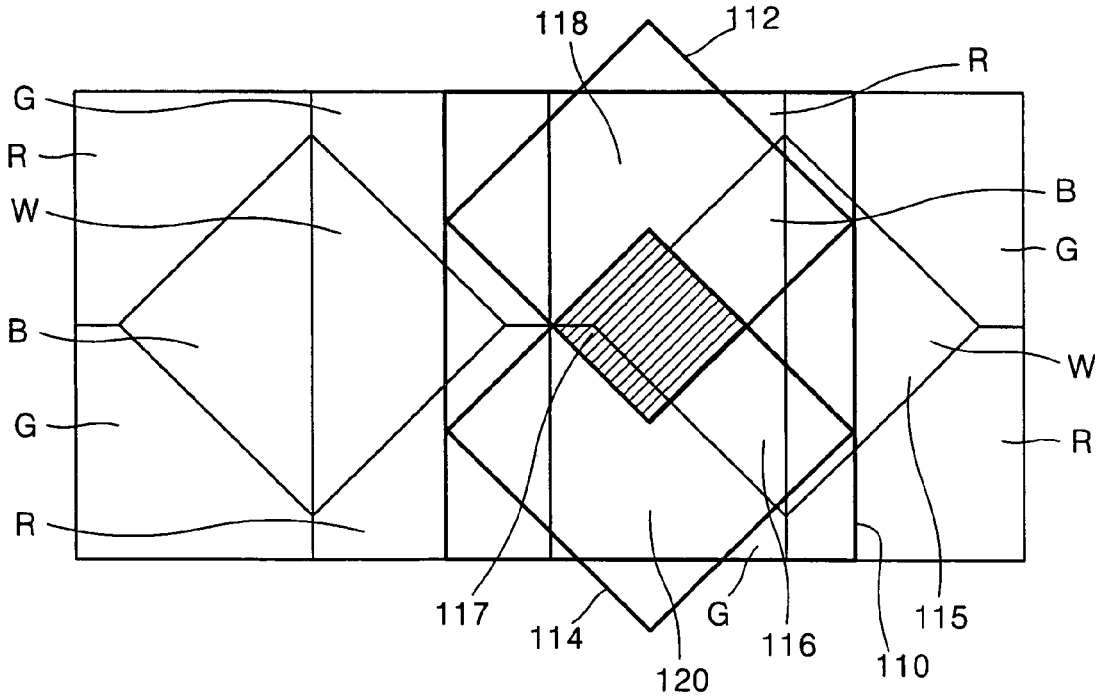
FIG. 12 is a diagram showing another example of a target filter to be applied to a target subpixel displaying a color having a relatively low absolute luminance value.

FIG. 12 is a diagram showing another example of a target filter to be applied to a target subpixel displaying a color having a relatively low absolute luminance value.

According to embodiments of the present invention, where it is determined that an absolute luminance value of a color displayed by a target subpixel 116 is equal to or less than the predetermined luminance value, a target phase positioned at the center of gravity of the target subpixel 116 and adjacent phases respectively positioned at the centers of gravity of adjacent subpixels 118 and 120 are shifted so that a target filter 110 overlaps adjacent filters 112 and 114. Here, the low-luminance filter 110 overlapping the adjacent filters 112 and 114 is determined as a target filter corresponding to the target subpixel 116. In other words, the target filter 110 shown in FIG. 12 is used to obtain a relative luminance value of the target subpixel 116 when an adjacent subpixel 115 displaying W is adjacent to the target subpixel 116 displaying B. Here, if the target filter 110 and the adjacent filters 112 and 114 are made to overlap one another in a hatched single common area 117, R, G and B are mixed so that a color similar to W is displayed. As a result, a color fringe occurring between B and W when a target phase is positioned at the center of gravity of the target subpixel 116 is eliminated. Consequently, referring to FIG. 12, the target filter 110 is designed such that the subpixel 116 displaying B and the adjacent subpixels 118 and 120 are regarded as constituting a group so that the adjacent phases of the respective adjacent filters 112 and 114 are the same as the target phase of the target filter 110.

The high-luminance filter and the low-luminance filter may change according to the position of a display pixel comprising a target subpixel in physical space.

After operation 10 shown in FIG. 4, the relative luminance value of the target subpixel is obtained from a relative luminance value of at least one image pixel using the target filter having the adjusted target phase as its center in operation 12. Obtaining the relative luminance value of the target subpixel is referred to as target subpixel rendering. The color displayed by the target subpixel has brightness corresponding to the relative luminance value of the target subpixel, which is obtained in operation 12.

Figure 13:
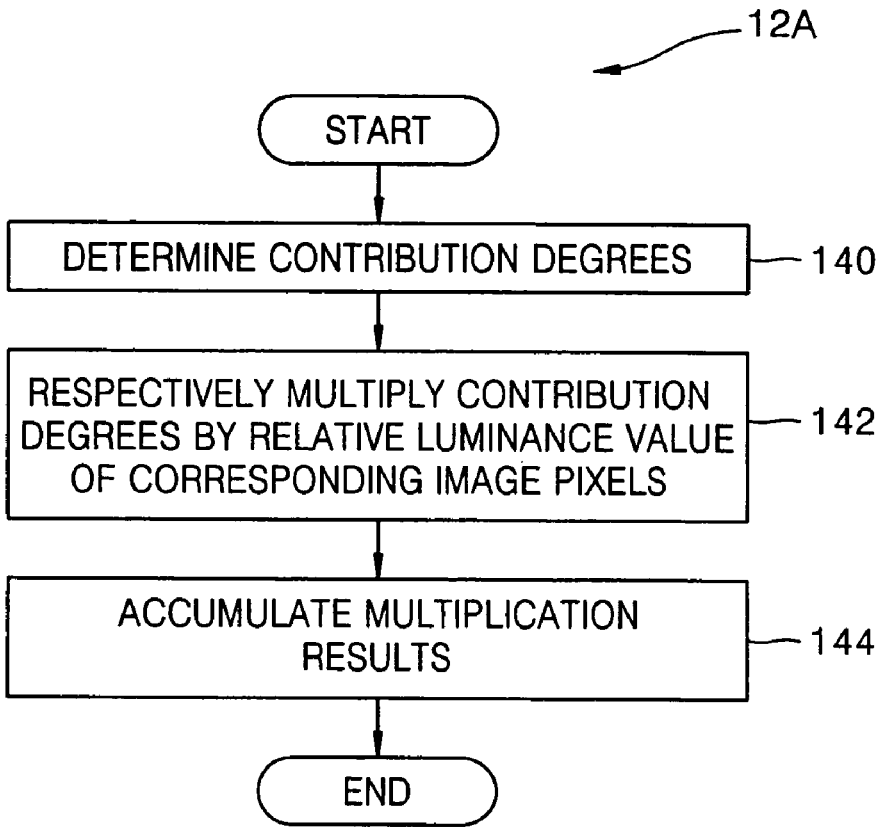
FIG. 13 is a flowchart of an embodiment of another operation shown in FIG. 4.

FIG. 13 is a flowchart of an embodiment 12A of operation 12 shown in FIG. 4 according to the present invention. Operation 12A comprises obtaining the relative luminance value of the target subpixel by accumulating results of respectively multiplying contributions by relative luminance values of image pixels in operations 140 through 144.

After operation 10, contribution degrees of respective M×N coefficients included in the target filter (where M and N are positive integers equal to or greater than 1) are determined in operation 140. A contribution degree indicates how much a coefficient included in the target filter contributes to displaying the color of the target subpixel. For example, an image pixel corresponding to a coefficient having a contribution degree of "0" does not contribute to the color display of a display subpixel and an image pixel corresponding to a coefficient having a contribution degree of "1" fully contributes to the color display of the display subpixel. Such a contribution degree may change according to at least one among a ratio between a resolution of an image and a resolution of an image display apparatus, an arrangement of subpixels, a color or luminance to be displayed by a subpixel, and a type of target filter. A type of target filter indicates whether a target filter is a high-luminance filter or a low-luminance filter.

Figure 14:
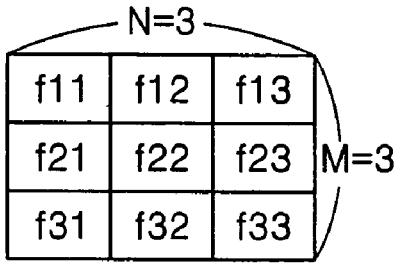
FIG. 14 is a diagram of an example of a target filter.

FIG. 14 is a diagram of an example of a target filter which includes nine coefficients f11, f12, f13, f21, f22, f23, f31, f32 and f33.

For example, when M=N=3, the target filter may be implemented as shown in FIG. 14; and contribution degrees of the respective coefficients f11 through f33 are determined in operation 140.

Figure 15:
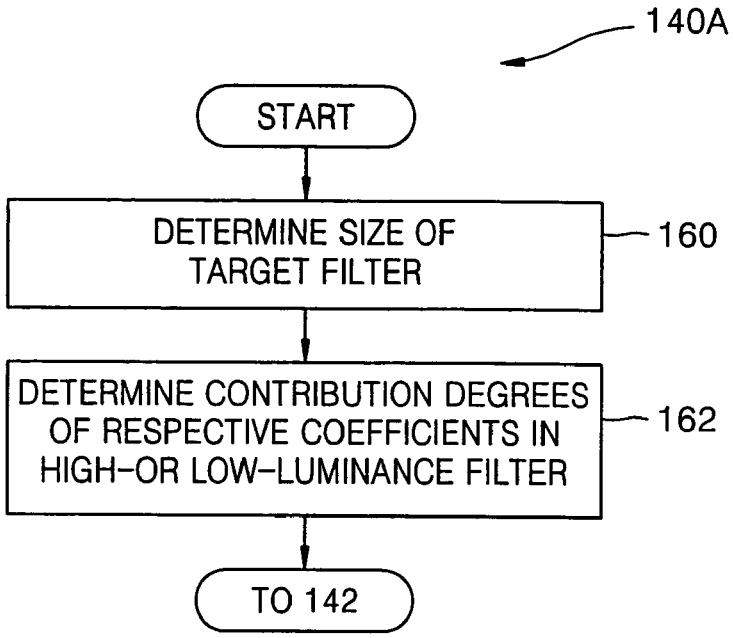
FIG. 15 is a flowchart of an embodiment of an operation shown in FIG. 13.

FIG. 15 is a flowchart of an embodiment 140A of operation 140 shown in FIG. 13. Operation 140A comprises determining a size of the target filter in operation 160 and determining the contribution degrees in operation 162.

More specifically, a size M×N of the target filter is determined in operation 160. The size of the target filter may be determined according to a ratio between a resolution of an image and a resolution of an image display apparatus. For example, when an image has a resolution of A×B and an image display apparatus has a resolution of C×D, the size of the target filter may be determined such that M is proportional to A/C and N is proportional to B/D.

After operation 160, contribution degrees of respective coefficients included in the high- or low-luminance filter determined as the target filter are determined using the determined size of the target filter in operation 162.

After operation 140, the determined contribution degrees are respectively multiplied by relative luminance values of image pixels corresponding to the coefficients of the target filter in operation 142.

For example, where the target filter is implemented as shown in FIG. 14, the contribution degrees of nine coefficients f11 through f33, which are determined in operation 140, are respectively multiplied by relative luminance values of image pixels corresponding to the coefficients f11 through f33, respectively, in operation 142. After operation 142, M×N multiplication results are accumulated, and an accumulation result is determined as the relative luminance value of the target subpixel in operation 144.

Operations 142 and 144 are expressed as Expression (1).

$$Sout(i) = \sum_{k,j=1,1}^{M,N} M(k, l)I(k, l) \tag{1}$$

In Expression (1), Sout(i) indicates a relative luminance value of a target subpixel, (k, l) is an index of a coefficient fkl included in the target filter, $1 \leqq k \leqq M$, and $1 \leqq l \leqq N$. M(k, l) is a contribution degree of the coefficient fkl, and $0 \leqq M(k, l) \leqq 1 \leqq l(k, l)$ indicates a relative luminance value of an image pixel corresponding to the coefficient fkl. In other words, a target filter having M×N coefficient(s) converts the relative luminance value(s) of respective M×N image pixel(s) into a relative luminance value to be expressed by a single subpixel.

According to embodiments of the present invention, taking into account a visual modulation transfer function (MTF) characteristic, the target filter may be formed to be a mask having a predetermined shape by minimizing a contribution of a particular coefficient among the coefficient(s) included in the target filter, and the relative luminance value of the target subpixel may be obtained from a relative luminance value of at least one image pixel using the mask in operation 12.

For example, where the target filter is implemented, as shown in FIG. 14, and where the contribution degrees of particular coefficients f11, f13, f31 and f33 among the coefficients f11 through f33 included in the target filter are set to be "0", the target filter becomes a mask having a predetermined shape, i.e., a diamond shape. In this situation, the filters 90, 92, 100, 102, 112 and 114 shown in FIGS. 10, 11 and 12 have a diamond shape.

Alternatively, where the target filter is implemented, as shown in FIG. 14, the target filter may be made to have a predetermined shape, i.e., a slim quadrangular shape, by setting contribution degrees of particular coefficients f13, f23 and f33 among the coefficients f11 through f33 included in the target filter to "0". In this situation, the filter 110 shown in FIG. 12 has a slim quadrangular shape.

Alternatively, where the target filter is implemented, as shown in FIG. 14, the target filter may be made to have a predetermined shape, i.e., a flat quadrangular shape, by setting contribution degrees of particular coefficients f31, f32 and f33 among the coefficients f11 through f33 included in the target filter to "0". In this situation, the filter 72 shown in FIG. 10 has a flat quadrangular shape.

Figure 3:
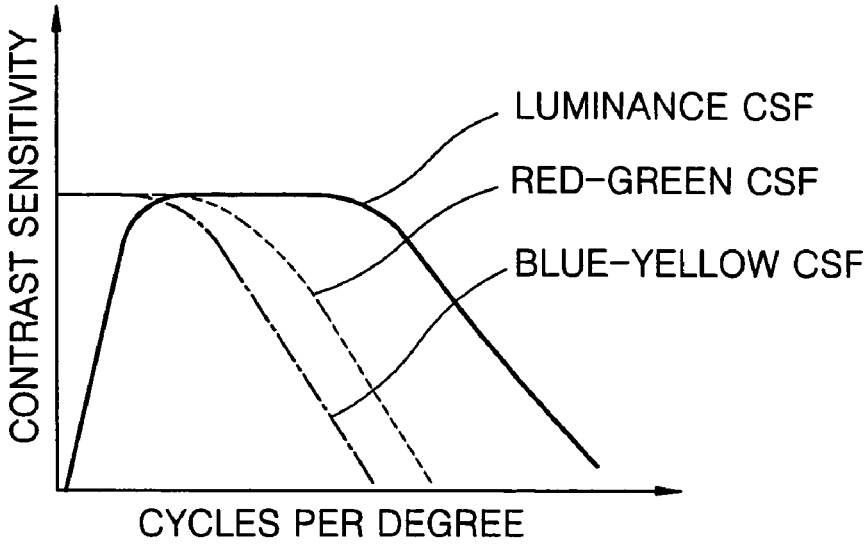
FIG. 3 is a graph illustrating characteristics of human sight according to a spatial frequency of an image.

Consequently, based on human perception of spatial resolution of color being lower than human perception of brightness shown in FIG. 3, in an image display method of the present invention, the center of gravity of a target subpixel is made to be a target phase with respect to a target filter of the target subpixel displaying a color having a relatively high absolute luminance value, as shown in FIG. 10, thereby improving visual resolution, i.e., spatial resolution. In other words, when a target filter to be used to obtain a relative luminance value of a target subpixel displaying a color having a relatively high absolute luminance value is designed, a high-luminance filter that increases the spatial resolution of an image to be displayed by the target subpixel is determined as the target filter in an image display method of the present invention.

In addition, in an image display method of the present invention, for a target filter of a target subpixel displaying a color having a relatively low absolute luminance value, the target filter is made to overlap adjacent filters, as shown in FIG. 11 or 12, so that color fringes are counterbalanced. In other words, when a target filter to be used to obtain a relative luminance value of a target subpixel displaying a color having a relatively low absolute luminance value is designed, a low-luminance filter that is designed to mix a chrominance component of an image to be displayed by the target subpixel with adjacent chrominance components is determined as the target filter, in the image display method of the present invention.

Hereinafter, the structure and operations of an image display apparatus according to the present invention will be described with reference to the attached drawings.

Figure 16:
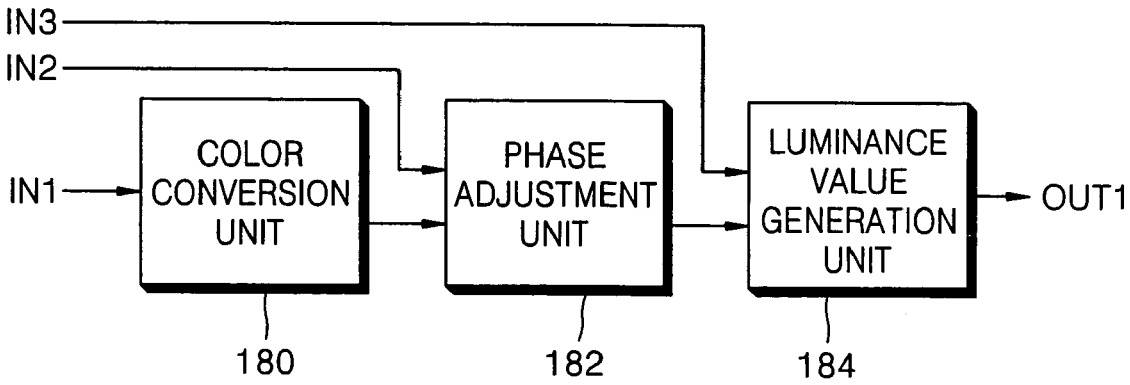
FIG. 16 is a block diagram of an image display apparatus according to an embodiment of the present invention.

FIG. 16 is a block diagram of an image display apparatus according to an embodiment of the present invention. The image display apparatus includes a color conversion unit 180, a phase adjustment unit 182, and a luminance value generation unit 184.

The image display apparatus shown in FIG. 16 performs the image display method shown in FIG. 4. In other words, the image display apparatus displays an image using a display pixel comprising at least one subpixel.

To perform the operation 8 shown in FIG. 4, the color conversion unit 180 of the image display apparatus shown in FIG. 16 converts three colors, e.g., R, G and B, externally received through an input terminal IN1 into four or more colors, e.g., R, G, B and W, and outputs a conversion result to the phase adjustment unit 182. Where the image display method shown in FIG. 4 does not include operation 8, the image display apparatus shown in FIG. 16 does not require the color conversion unit 180. Where color conversion is not required, the phase adjustment unit 182 may directly receive multiple colors through an input terminal IN2.

To perform the operation 10 shown in FIG. 4, the phase adjustment unit 182 adjusts a target phase of a target subpixel using a difference between an absolute luminance value of a color to be displayed by the target subpixel and an absolute luminance value of a color to be displayed by a subpixel adjacent to the target subpixel. For operation 10, the phase adjustment unit 182 may externally receive the absolute luminance value of the color to be displayed by the target subpixel and the absolute luminance value of the color to be displayed by the subpixel adjacent to the target subpixel through the input terminal IN2 or may receive the absolute luminance values of the target subpixel and the adjacent subpixel from the color conversion unit 180.

The phase adjustment unit 182 may be used to perform the above-described embodiments of an image display method. For example, to perform the above-described first embodiment, the phase adjustment unit 182 shifts a target phase such that a distance between the target phase and the center of gravity of an adjacent subpixel displaying a color having a high absolute luminance value becomes larger. To perform the above-described second embodiment, the phase adjustment unit 182 shifts a target phase and at least one adjacent phase such that a target filter overlaps an adjacent filter. To perform the above-described third embodiment, the phase adjustment unit 182 shifts a target phase and at least one adjacent phase such that a target filter overlaps at least one adjacent filter in a single common area.

Figure 17:
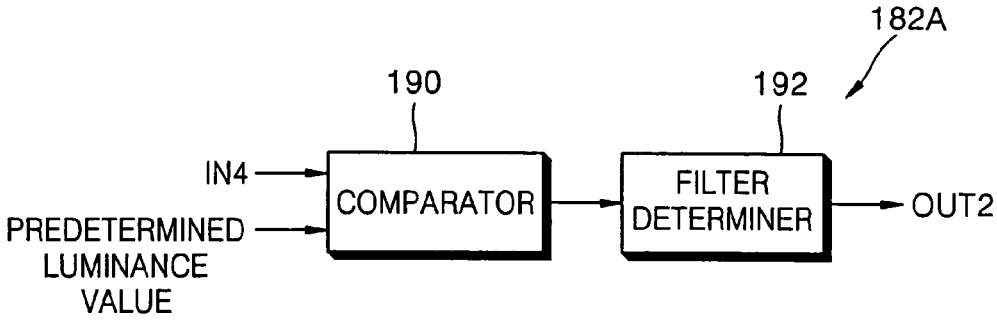
FIG. 17 is a block diagram of an embodiment of a phase adjustment unit shown in FIG. 16.

FIG. 17 is a block diagram of an embodiment 182A of the phase adjustment unit 182 shown in FIG. 16. The phase adjustment unit 182A comprises a comparator 190 and a filter determiner 192. The phase adjustment unit 182A performs operation 10A shown in FIG. 9.

To perform operation 60 shown in FIG. 9, the comparator 190 receives an absolute luminance value of a color to be displayed by a target subpixel through an input terminal IN4, compares the received absolute luminance value of the color to be displayed by the target subpixel with a predetermined luminance value, and outputs a comparison result to the filter determiner 192.

To perform operation 62 or 64, the filter determiner 192 determines a high-luminance filter or a low-luminance filter as a target filter in response to the comparison result received from the comparator 190 and outputs the determination result to the luminance value generation unit 184 through an output terminal OUT2. For example, where a determination is made that the absolute luminance value of the color to be displayed by the target subpixel is greater than the predetermined luminance value based on the comparison result, the filter determiner 192 determines a high-luminance filter as the target filter. However, where a determination is made that the absolute luminance value of the color to be displayed by the target subpixel is equal to or less than the predetermined luminance value based on the comparison result, the filter determiner 192 determines a low-luminance filter as the target filter.

To perform the operation 12 shown in FIG. 4, the luminance value generation unit 184 generates a relative luminance value of a target subpixel from a relative luminance value of at least one image pixel using a target filter having an adjusted target phase as the center of the target filter and outputs the generated relative luminance value of the target subpixel through an output terminal OUT1. The luminance value generation unit 184 may receive a target filter from a filter generator (not shown). The filter generator generates a target filter having a target phase as the center of the target filter and may be provided within the phase adjustment unit 182, provided within the luminance value generation unit 184, or provided separately. Where the filter generator is provided within the phase adjustment unit 182, the luminance value generation unit 184 receives the target filter from the phase adjustment unit 182. Where the filter generator is provided separately, the luminance value generation unit 184 receives a target filter through an input terminal IN3.

Figure 18:
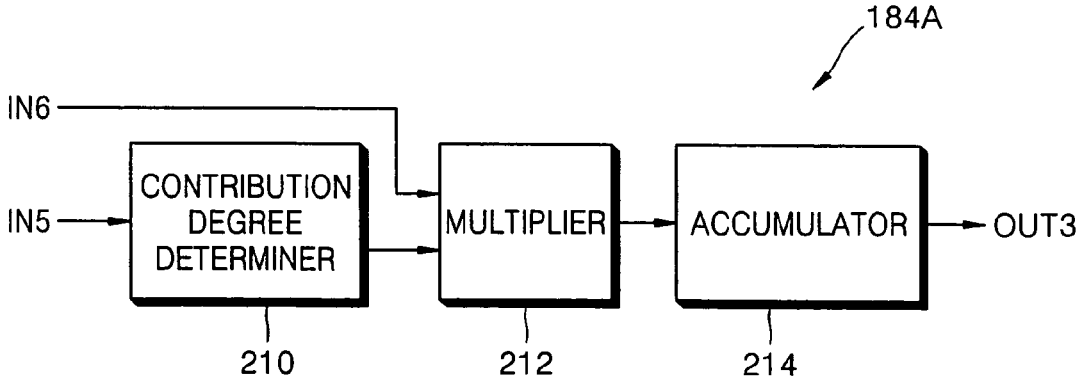
FIG. 18 is a block diagram of an embodiment of a luminance value generation unit shown in FIG. 16.

FIG. 18 is a block diagram of an embodiment 184A of the luminance value generation unit 184 shown in FIG. 16. The luminance value generation unit 184A comprises a contribution degree determiner 210, a multiplier 212, and an accumulator 214. The luminance value generation unit 184A shown in FIG. 18 performs operation 12A shown in FIG. 13.

To perform operation 140 shown in FIG. 13, the contribution degree determiner 210 determines a contribution degree of each of M×N coefficients included in a target filter received through an input terminal IN5 and outputs respective determined contribution degrees to the multiplier 212.

To perform operation 142, the multiplier 212 multiplies each contribution degree determined by the contribution degree determiner 210 by a relative luminance value of an image pixel corresponding to a coefficient and outputs a multiplication result to the accumulator 214. For these operations, the multiplier 212 receives a relative luminance value of an image pixel corresponding to each coefficient through an input terminal IN6.

To perform operation 144, the accumulator 214 accumulates M×N multiplication results received from the multiplier 212 and outputs an accumulation result as a relative luminance value of a target subpixel through an output terminal OUT3.

Consequently, according to the apparatus for and method of displaying an image according to the present invention, relative luminance values of all subpixels are determined, and a color of each target subpixel is displayed at a brightness corresponding to a relative luminance value output through the output terminal OUT1.

A computer program for controlling an image display apparatus according to the present invention may be stored on a computer-readable recording medium. The computer program comprises instructions for operating a computer to adjust a target phase of a target subpixel using a difference between an absolute luminance value of a color to be displayed by the target subpixel and an absolute luminance value of a color to be displayed by a subpixel adjacent to the target subpixel, and instructions for operating the computer to obtain a relative luminance value of the target subpixel from a relative luminance value of at least one image pixel using a target filter having the adjusted target phase as a center of the target filter.

As described above, in an image display method and apparatus and a computer-readable recording medium for storing a computer program according to the present invention, subpixel rendering is achieved using different filters, that is, a relative luminance value to be displayed by a target subpixel is obtained using a target filter generated based on a difference in absolute luminance value between the target subpixel and adjacent subpixels, so that a color having a relatively low absolute luminance value may be displayed with a reduced color fringe and a color having a relatively high absolute luminance value may be displayed with an increased resolution. As a result, aliasing, which is a cause of quality degradation generated in displaying high-resolution images, is reduced. In addition, since a resolution of an image is improved without increasing a number of physical subpixels, a size of a driver chip may be reduced in comparison with increasing the number of physical subpixels to improve the resolution, fine processes are eliminated, and an amount of light transmitted by filters is increased. In particular, where white is additionally displayed by subpixels besides red, green and blue, an amount of output light is increased. Also, when a primary color is additionally displayable besides red, green, and blue, a color gamut displayed by an image display apparatus is extended.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of displaying an image using a display pixel comprising at least one subpixel displaying one among four or more colors, the method comprising:

adjusting a target phase of a target subpixel using a difference between an absolute luminance value of a color to be displayed by the target subpixel and an absolute luminance value of a color to be displayed by at least one subpixel adjacent to the target subpixel; and obtaining a relative luminance value of the target subpixel based on a relative luminance value of at least one image pixel using a target filter having the adjusted target phase as a center of the target filter, wherein a brightness of the color displayed by the target subpixel corresponds to the obtained relative luminance value of the target subpixel, and the adjusting of the target phase comprises determining a high-luminance filter or a low-luminance filter for the target subpixel to be displayed and the at least one adjacent subpixel to be displayed according to the respective absolute luminance value of the respective subpixel, the high-luminance filter being determined where the absolute luminance value of the respective subpixel is greater than a predetermined value and the low-luminance filter being determined where the absolute luminance value of the respective subpixel is equal to or less than the predetermined value, and where the high-luminance filter is determined for the target subpixel and the low-luminance filter is determined for the at least one adjacent subpixel, shifting the target phase such that a distance between the target phase and the at least one adjacent phase becomes larger, a center of the high-luminance filter determined as the target filter corresponds to the shifted target phase, and the low-luminance filter has the adjacent phase as a center of the low-luminance filter.

2. The method of claim 1, wherein the four or more colors comprise a color having a high absolute luminance value.

3. The method of claim 2, wherein the adjusting of the target phase comprises shifting the target phase such that a distance between the target phase and a center of gravity of an adjacent subpixel displaying a color having the high absolute luminance value increases.

4. The method of claim 1, wherein the adjusting of the target phase comprises shifting the target phase and an adjacent phase of at least one adjacent subpixel such that a target filter having the target phase as a center of the target filter overlaps an adjacent filter having the adjacent phase as a center of the adjacent filter.

5. The method of claim 4, wherein the adjusting of the target phase comprises shifting the target phase and the adjacent phase such that the target filter overlaps the adjacent filter in a single common area.

6. The method of claim 1, further comprising converting externally input three colors into the four or more colors before the adjusting of the target phase.

7. A computer-readable recording medium for storing at least one computer program to control an apparatus for displaying an image using a display pixel comprising at least one subpixel displaying one among four or more colors, the computer program implementing the method of claim 1.

8. A method of displaying an image using a display pixel comprising at least one subpixel displaying one among four or more colors, the method comprising:

adjusting a target phase of a target subpixel using a difference between an absolute luminance value of a color to be displayed by the target subpixel and an absolute luminance value of a color to be displayed by at least one subpixel adjacent to the target subpixel; and obtaining a relative luminance value of the target subpixel based on a relative luminance value of at least one image pixel using a target filter having the adjusted target phase as a center of the target filter, wherein a brightness of the color displayed by the target subpixel corresponds to the obtained relative luminance value of the target subpixel, the adjusting of the target phase comprises determining whether the absolute luminance value of the color to be displayed by the target subpixel is greater than a predetermined luminance value, where the determination is made that the absolute luminance value of the color to be displayed by the target subpixel is greater than the predetermined luminance value, determining a high-luminance filter as the target filter, and where the determination is made that the absolute luminance value of the color to be displayed by the target subpixel is equal to or less than the predetermined luminance value, determining a low-luminance filter as the target filter, the obtaining the relative luminance value of the target subpixel comprises making the target filter into a mask having a predetermined shape by minimizing a contribution degree of one particular coefficient among coefficients included in the target filter, and obtaining the relative luminance value of the target subpixel from the relative luminance value of the at least one image pixel using the mask.

9. The method of claim 8, wherein the predetermined luminance value is set to be approximately equal to an absolute luminance value of green.

10. The method of claim 8, wherein the high-luminance filter and the low-luminance filter change according to a position of a display pixel comprising the target subpixel in physical space.

11. The method of claim 8, wherein the obtaining the relative luminance value of the target subpixel comprises:

determining a contribution degree of each of M×N coefficients included in the target filter, wherein M and N are integers equal to or greater than 1;

multiplying the determined contribution degree by a relative luminance value of an image pixel corresponding to each coefficient; and accumulating M ×N multiplication results and determining an accumulation result as the relative luminance value of the target subpixel, wherein the contribution degree indicates an amount of contribution of the corresponding coefficient to displaying the color of the target subpixel.

12. The method of claim 11, wherein the contribution degree changes according to at least one of a ratio between a resolution of an image to be displayed and a resolution of a displayed image, an arrangement of the subpixel, a color or luminance to be displayed by the subpixel, or a shape of the target filter.

13. The method of claim 11, wherein step the determining the contribution degree of each of M×N coefficients included in the target filter comprises:

determining a size M×N of the target filter; and determining the contribution degree of each of coefficients included in the high-luminance filter or the low-luminance filter, using the determined size.

14. The method of claim 13, wherein the determining of the size M×N of the target filter comprises determining the size M×N according to a ratio between a resolution of the image to be displayed and a resolution of a displayed image.

15. The method of claim 8, wherein, where the target filter is determined as the high-luminance filter, the method further comprises:

positioning the target phase of the high-luminance filter at the center of gravity of the target subpixel in physical space.

16. The method of claim 8, wherein where the low-luminance filter is determined as the target filter, the method further comprises:

shifting the target phase positioned at a center of gravity of the target subpixel and an adjacent phase positioned at a center of gravity of the at least one subpixel adjacent to the target pixel so that the target filter overlaps an adjacent filter, and the low-luminance filter corresponds to the target filter overlapping the adjacent filter.

17. The method of claim 8, wherein the color that is displayed by the target subpixel and has the absolute luminance value greater than the predetermined luminance value is one selected from the group consisting of Y, L, white, cyan, and yellow in an opponent color space.

18. An apparatus for displaying an image using a display pixel comprising at least one subpixel displaying one among four or more colors, the apparatus comprising:

a phase adjustment unit which adjusts a target phase of a target subpixel using a difference between an absolute luminance value of a color to be displayed by the target subpixel and an absolute luminance value of a color to be displayed by at least one subpixel adjacent to the target subpixel; and a luminance value generation unit which generates a relative luminance value of the target subpixel from a relative luminance value of at least one image pixel using a target filter having the adjusted target phase as a center of the target filter, wherein a brightness of the color displayed by the target subpixel corresponds to the generated relative luminance value of the target subpixel, and the phase adjustment unit determines a high-luminance filter or a low-luminance filter for the target subpixel to be displayed and the at least one adjacent subpixel to be displayed according to the respective absolute luminance value of the respective subpixel, the high-luminance filter being determined where the absolute luminance value of the respective subpixel is greater than a predetermined value and the low-luminance filter being determined where the absolute luminance value of the respective subpixel is equal to or less than the predetermined value, and where the high-luminance filter is determined for the target subpixel and the low-luminance filter is determined for the at least one adjacent subpixel, shifting the target phase such that a distance between the target phase and the at least one adjacent phase becomes larger, a center of the high-luminance filter determined as the tarn et filter corresponds to the shifted target phase, and the low-luminance filter has the adjacent phase as a center of the low-luminance filter.

19. The apparatus of claim 18, wherein the four or more colors comprise a color having a high absolute luminance value.

20. The apparatus of claim 19, wherein the phase adjustment unit shifts the target phase such that a distance between the target phase and a center of gravity of an adjacent pixel displaying a color having the high absolute luminance value increases.

21. The apparatus of claim 18, wherein the phase adjustment unit shifts the target phase and an adjacent phase of an adjacent subpixel such that a target filter having the target phase as a center of the target filter overlaps an adjacent filter having the adjacent phase as a center of the adjacent filter.

22. The apparatus of claim 21, wherein the phase adjustment unit shifts the target phase and the adjacent phase such that the target filter overlaps the adjacent filter in a single common area.

23. The apparatus of claim 18, wherein the phase adjustment unit comprises:

a comparator which compares the absolute luminance value of the color to be displayed by the target subpixel with a predetermined luminance value; and a filter determiner which determines one of a high-luminance filter and a low-luminance filter as the target filter in response to the comparison result and outputs a determination result to the luminance value generation unit.

24. The apparatus of claim 18, wherein the luminance value generation unit comprises:

a contribution degree determiner which determines a contribution degree of each of M×N coefficients included in the target filter wherein M and N are integers equal to or greater than 1;

a multiplier which multiplies the determined contribution degree by a relative luminance value of the image pixel corresponding to each coefficient; and an accumulator which accumulates M×N multiplication results and outputs an accumulation result as the relative luminance value of the target subpixel, wherein the contribution degree indicates how much the corresponding coefficient contributes to displaying the color of the target subpixel.

25. The apparatus of claim 18, further comprising a color conversion unit which converts extemally input three colors into the four or more colors and outputs a conversion result to the phase adjustment unit.

* * * * *

UNITED STATES PATENT AND TRADEMARK OFFICE

CERTIFICATE OF CORRECTION

PATENT NO. : 7,505,052 B2
APPLICATION NO. : 10/942976
DATED : March 17, 2009
INVENTOR(S) : Wonhee Choe et al.

It is certified that error appears in the above-identified patent and that said Letters Patent is hereby corrected as shown below:

Column 14, Line 60, change “M xN” to --MxN--.

Column 16, Line 9, change “tarn et” to --target--.

Column 16, Line 55, change “extemally” to --externally--.

Signed and Sealed this

Sixteenth Day of June, 2009

JOHN DOLL
*Acting Director of the United States Patent and Trademark Office*